US006189973B1

(12) United States Patent
Wu

(10) Patent No.: US 6,189,973 B1
(45) Date of Patent: Feb. 20, 2001

(54) SEAT HAVING A FOLDABLE BACK

(76) Inventor: Tian Tsyh Wu, No. 420, Sec. 3, Song Ju Road, Taichung (TW), 406

( * ) Notice: Under 35 U.S.C. 154(b), the term of this patent shall be extended for 0 days.

(21) Appl. No.: 09/564,946

(22) Filed: May 5, 2000

(51) Int. Cl.[7] ..... A47C 1/024

(52) U.S. Cl. ..... 297/378.1; 297/DIG. 2; 297/440.15

(58) Field of Search ..... 297/440.15, 378.1, 297/DIG. 2

(56) References Cited

U.S. PATENT DOCUMENTS 4,871,209 * 10/1989 Handleman ..... 297/378.1
5,820,220 * 10/1998 Wu ..... 297/378.1
6,015,190 * 10/1989 Wend ..... 297/378.1

* cited by examiner

*Primary Examiner*—Anthony D. Barfield
(74) *Attorney, Agent, or Firm*—Charles E. Baxley

(57) ABSTRACT

A seat includes a base having a block extended rearward for forming a pair of notches. The block has two side extensions extended inward of the notches of the base. A plate has an opening formed between two legs for receiving the block and has two pins engaged into the extensions for rotating the plate relative to the base between a vertical position and a folded position. The pins may be engaged into the notches of the base for securing the plate at the vertical position. The legs each has a stop engaged with the extensions for retaining the plate to the base.

8 Claims, 6 Drawing Sheets

SEAT HAVING A FOLDABLE BACK

BACKGROUND OF THE INVENTION

1. Field of the Invention

The present invention relates to a seat. and more particularly to a seat of a chair having a foldable seat back.

2. Description of the Prior Art

Typical chairs, particularly the seat of the chairs comprise a seat back solidly secured to the rear portion thereof and may not be folded relative to the seat such that the seat comprise a huge volume which is adverse for storing and transportation purposes.

The present invention has arisen to mitigate and/or obviate the afore-described disadvantages of the conventional chairs or seats.

SUMMARY OF THE INVENTION

The primary objective of the present invention is to provide a seat including a seat back foldable to a compact configuration for greatly reducing the volume of the seat and for facilitating the storing and transportation of the seat.

The other objective of the present invention is to provide a seat including a seat back that may be easily rotated and folded relative to a base to the compact configuration.

In accordance with one aspect of the invention, there is provided a seat comprising a base including a rear portion having a block extended rearward therefrom for defining a pair of notches in the rear portion of the base, the block including two sides each having an extension extended therefrom and extended inward of the notches of the base respectively, and a plate including an opening formed therein and defined between a pair of legs, the plate including a pair of pivot pins extended from the legs respectively and extended inward of the opening of the plate for engaging into the recesses of the extensions respectively. The plate is rotatable about the pivot pins relative to the base between a vertical position and a horizontal folded position relative to the base, and the legs are engaged in the notches of the base respectively when the plate is rotated to the vertical position relative to the base. The seat may be folded to the compact configuration for greatly reducing the volume of the seat and for facilitating the storing and transportation of the seat when the plate or the seat back is rotated and folded to engage with the base.

The extensions of the block each includes a recess formed therein and communicating with the notches of the base, the pivot pins are engaged into the notches of the base when the plate is rotated to the vertical position relative to the base and when the plate is released.

The block includes a jut extended therefrom, the plate includes a cavity formed therein for receiving the jut of the block and for securing the plate to the base. The extensions of the block each includes a projection extended therefrom, the plate includes a pair of depressions formed therein for receiving the projections of the extensions and for securing the plate to the base.

A retaining device is further provided for retaining the plate to the base and includes a pair of stops secured to the legs and engaged with the extensions for engaging with the extensions and for retaining the plate to the base. The legs each includes a slot formed therein for receiving the stops respectively, the stops each includes a protrusion extended inward of the opening of the plate for engaging with the extensions. The extensions each includes a curved surface formed therein for engaging with the protrusions of the stops and for guiding a rotation of the legs of the plate relative to the extensions of the block.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
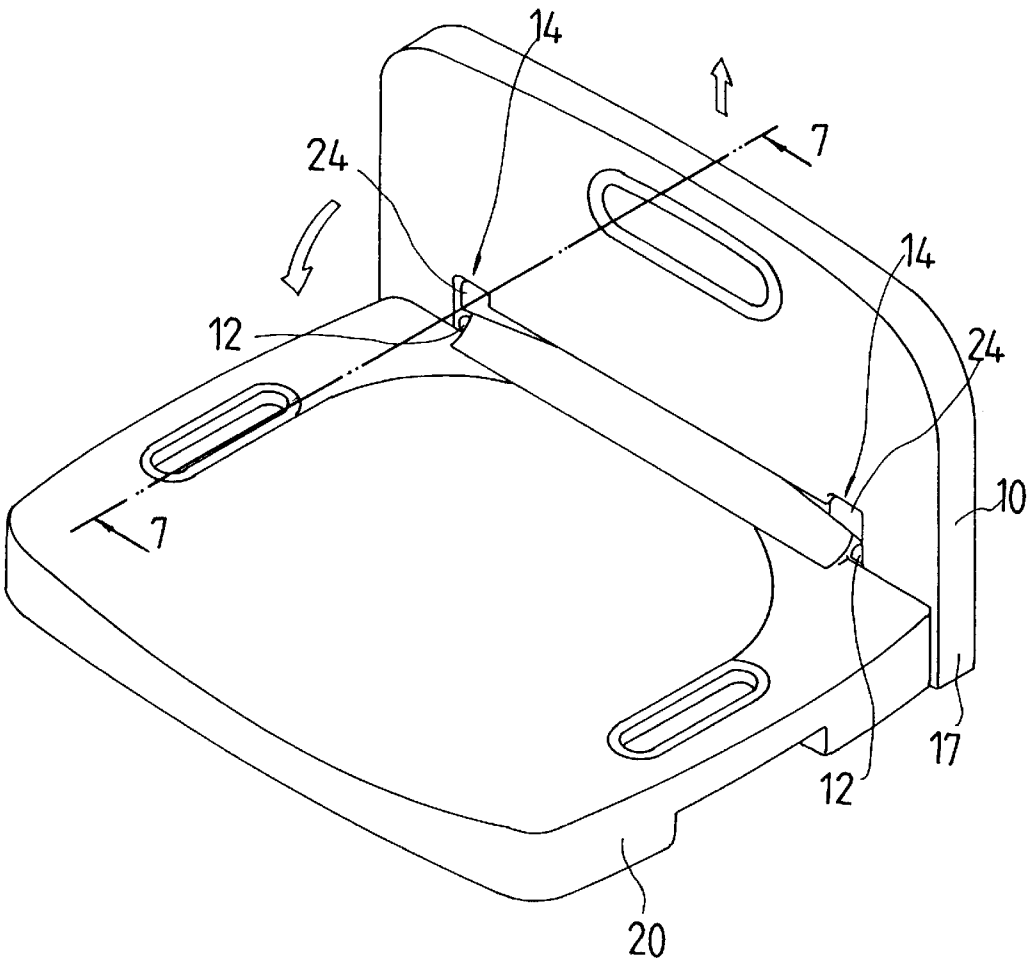
FIG. 1 is a perspective view of a seat in accordance with the present invention, in which the seat back is rotated to an upward extending position.
Figure 2:
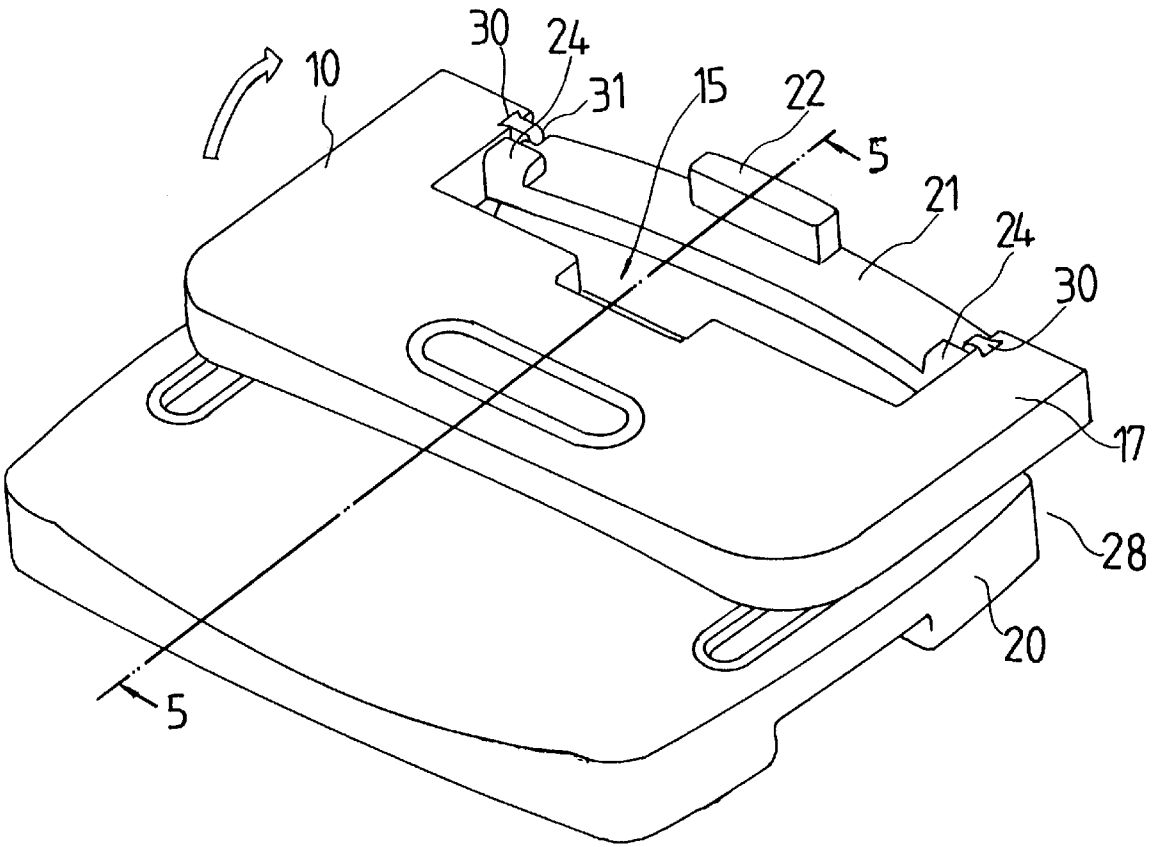
FIG. 2 is a perspective view of the seat, in which the seat back is rotated to a downward and folded position.
Figure 3:
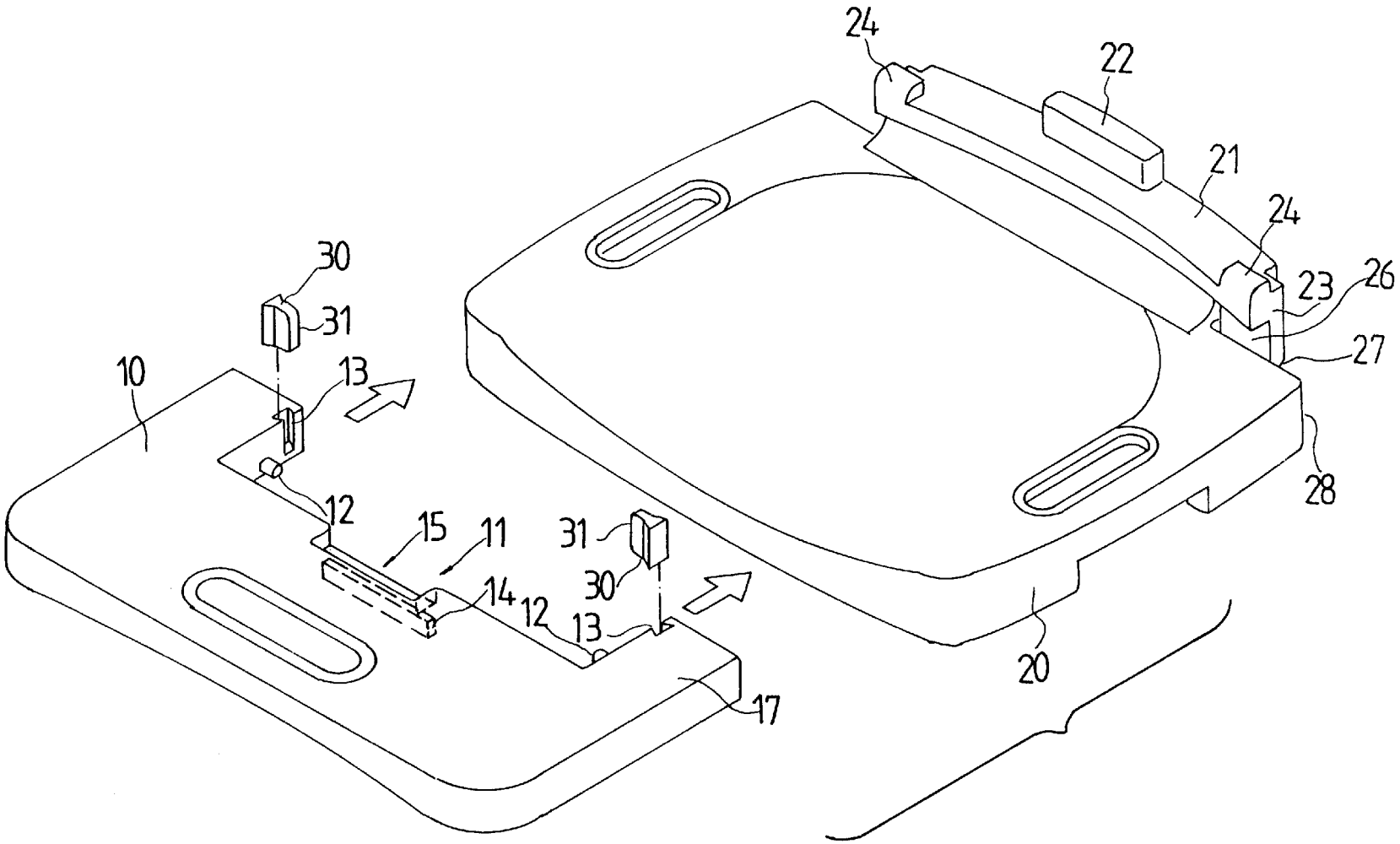
FIG. 3 is an exploded view of the seat.
Figure 4:
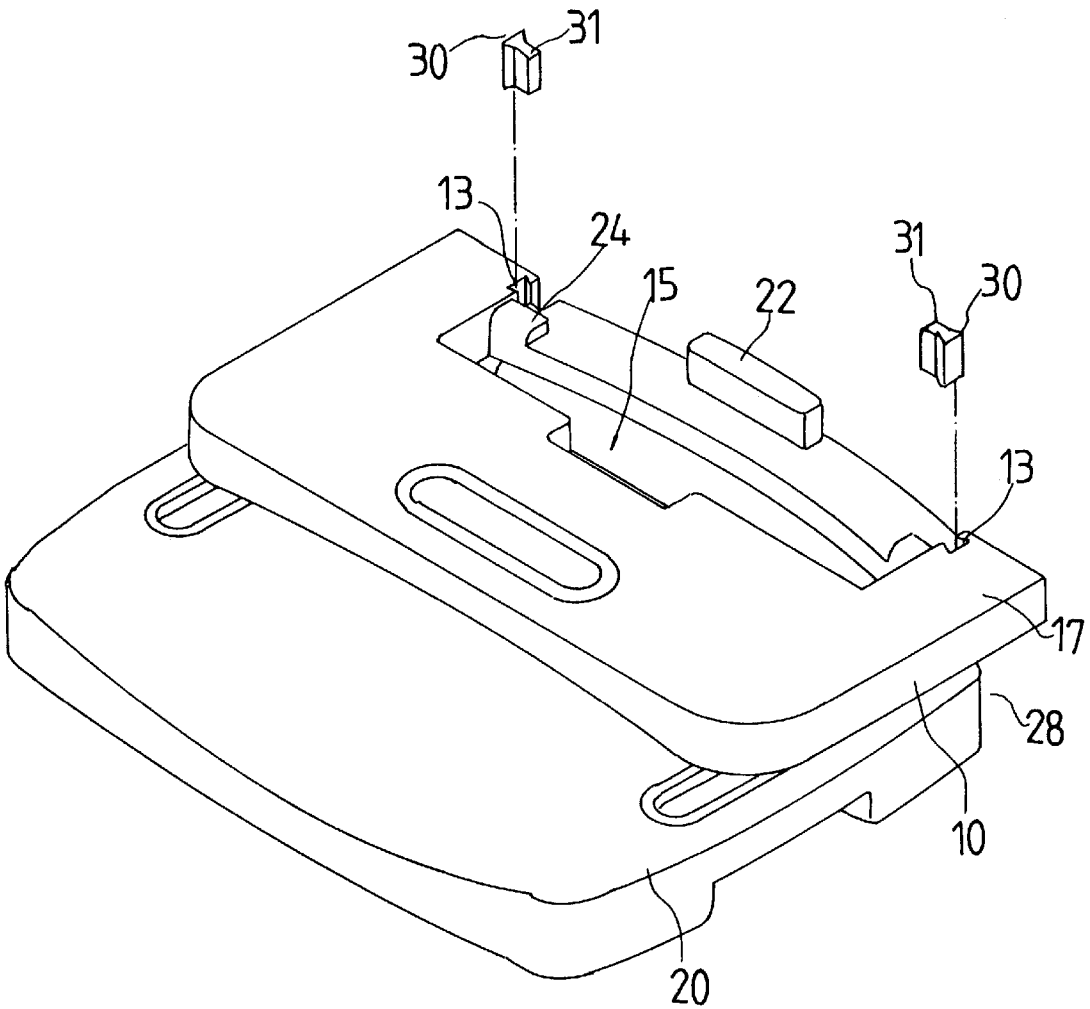
FIG. 4 is a perspective view of the seat at the folded position, in which stops are disengaged from the seat back.
Figure 5:
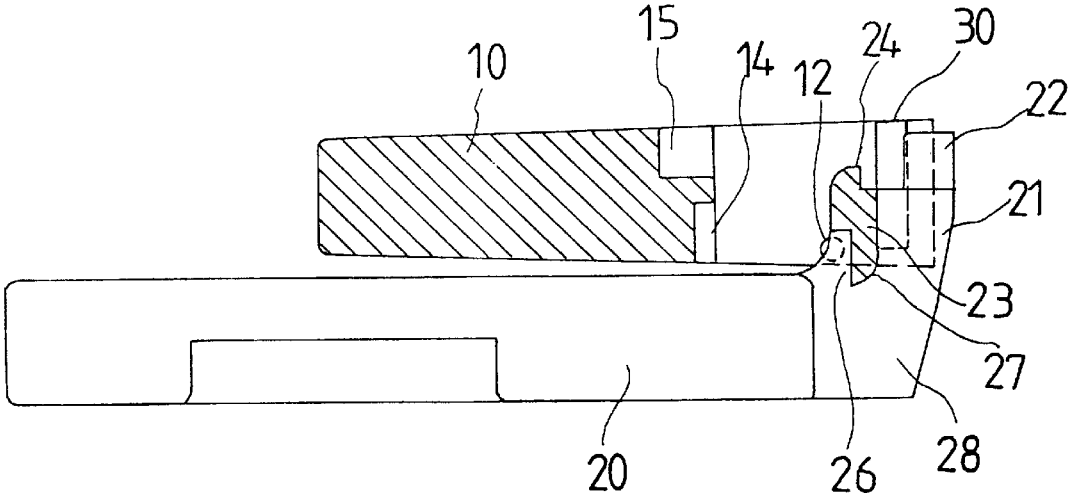
FIG. 5 is a cross sectional view taken along lines 5—5 of FIG. 2.

Referring to the drawings, and initially to FIGS. 1–5, a seat in accordance with the present invention may be a seat of a chair, or may be a seat of a vehicle or the like. The seat comprises a seat back or a plate 10 pivotally or rotatably secured to a base 20 and foldable relative to the base 20 between a vertical or upwardly extending position (FIGS. 7, 8) and a horizontal or folded position (FIGS. 1, 2, 5).

The base 20 includes a rear portion having a block 21 extended rearward therefrom and having a pair of notches 28 defined between the sides of the block 21 and the base 20; i.e., the block 21 includes a width smaller than that of the base 20 for defining the notches 28 between the sides of the block 21 and the base 20. The block 21 includes a jut 22 extended upward therefrom, particularly extended upward from the middle portion thereof. The block 21 includes two sides each having an extension 23 extended laterally outward therefrom and extended into the respective notches 28 of the base 20. The extensions 23 of the block 21 each includes a projection 24 extended upward therefrom and each includes a recess 26 formed in the front portion thereof and communicating with the respective notches 28 of the base 20. The extensions 23 each includes a tapered or curved surface 27 formed in the bottom portion thereof.

Figure 6:
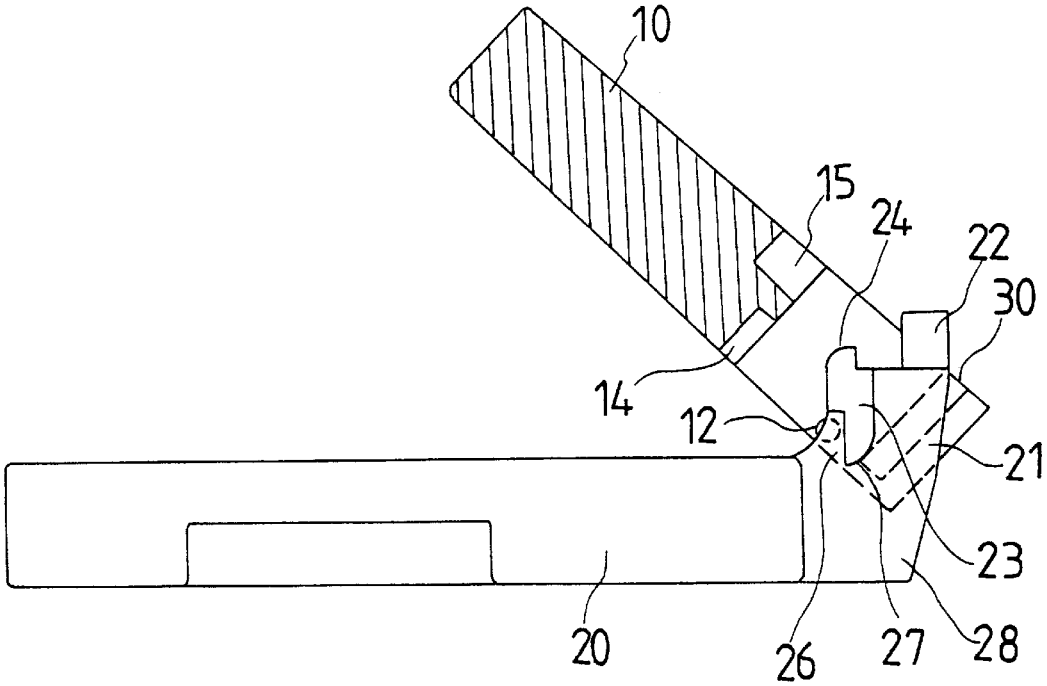
FIG. 6 is a cross sectional view similar to FIG. 5, illustrating the operation of the seat.
Figure 7:
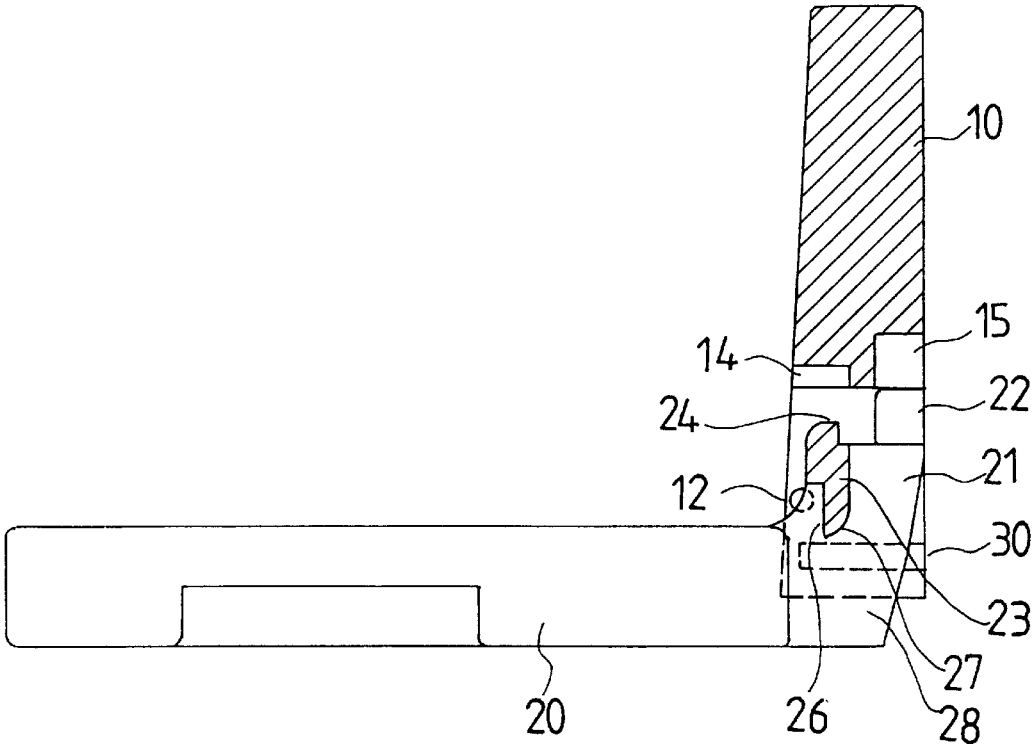
FIG. 7 is a cross sectional view taken along lines 7—7 of FIG. 1.
Figure 8:
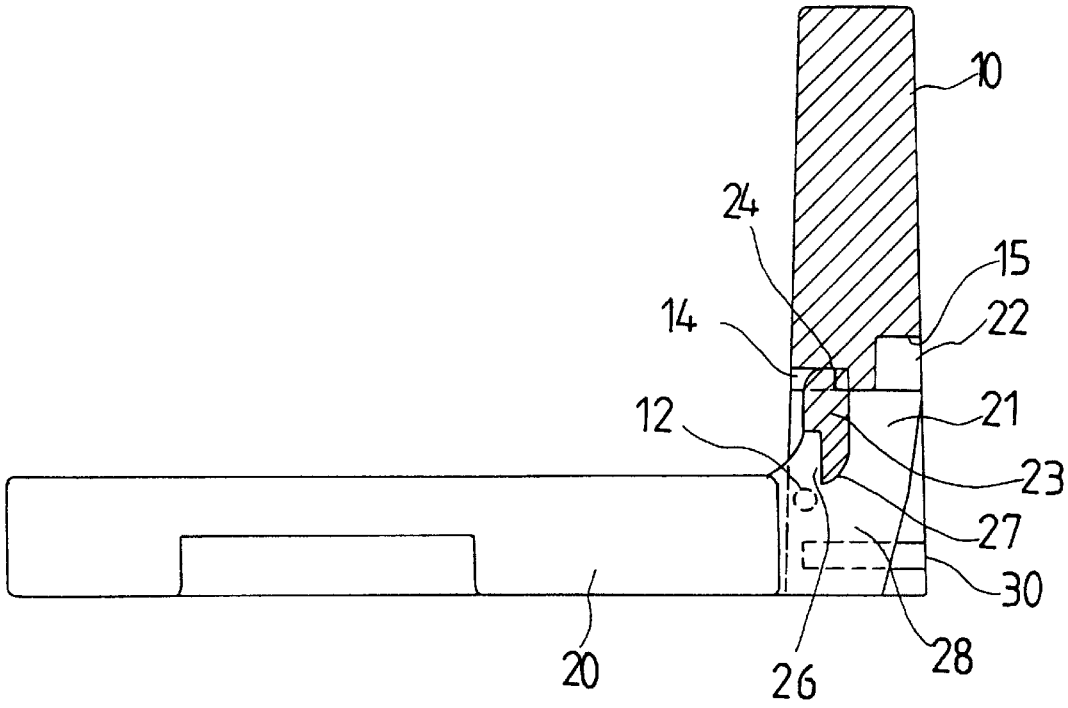
FIG. 8 is a cross sectional view similar to FIG. 7, illustrating the operation of the seat.

The seat back or the plate 10 includes an opening 11 formed therein, such as formed in the bottom portion thereof, for slidably receiving the block 21 and the extensions 23 of the block 21. The opening 11 may be formed or defined between a pair of legs 17 that are extended downward from the sides of the plate 10. The plate 10 includes a pair of pivot pins 12 secured thereto or extended inward of the opening 11 of the plate 10 from the legs 17 respectively, for engaging into the respective recesses 26 of the extensions 23 (FIGS. 5–7) and for engaging into the respective notches 28 of the base 20 (FIG. 8). The plate 10 includes a pair of slots, such as the dovetail slots 13 oppositely formed therein for receiving the respective stops 30 each of which includes a protrusion 31 extended inward of the opening 11 of the plate 10 for engaging with the extensions 23 and for retaining the pivot pins 12 in the recesses 26 of the extensions 23 respectively and for preventing the pivot pins 12 from being disengaged from the recesses 26 of the extensions 23 and for preventing the plate 10 from being disengaged from the base 20 (FIGS. 2–4). The stops 30 thus may be used for retaining or for coupling the plate 10 to the base 20. The sliding engagement of the protrusions 31 of the stops 30 with the curved surfaces 27 of the extensions 23 may guide the legs 17 to rotate relative to the extensions 23 of the block 21.

As shown in FIGS. 2–4, the plate 10 includes a cavity 15 formed therein for receiving the jut 22 of the block 21 (FIGS. 7, 8) when the plate 10 is erected relative to the base 20 and when the plate 10 is moved downward relative to the base 20 (FIG. 8). The plate 10 further includes a pair of depressions 14 formed therein for receiving the projections 24 of the extensions 23 (FIGS. 1, 8) and for solidly securing the plate 10 at the erected working position relative to the base 20. The protrusions 31 of the stops 30 may engage with the curved surfaces 27 of the extensions 23 when the plate 10 is rotated from the vertical working position (FIG. 7) through the middle folding position (FIG. 6) and to the downward folding position (FIG. 5), or when the plate 10 is rotated from the downward folding position (FIG. 5) through the middle folding position (FIG. 6) and to the vertical working position (FIG. 7), such that the plate 10 may be smoothly folded or rotated relative to the base 20.

In operation the plate 10 may be rotated between the vertical working position (FIG. 7) and the downward folding position (FIG. 5) about the pivot pins 12 because the pivot pins 12 may be retained in the recesses 26 of the extensions 23. When the plate 10 is rotated to the vertical working position (FIG. 7), the legs 17 of the plate 10 may be engaged into the respective notches 28 of the base 20. When the plate 10 is released, the plate 10 may move downward relative to the base 20 to the position as shown in FIG. 8 by its own weight, such that the pivot pins 12 may be engaged into the notches 28 of the base 20 and such that the plate 10 may be solidly retained at the vertical working position relative to the base 20. When it is required to fold the plate 10 relative to the base 20, the plate 10 is pulled upward to the position as shown in FIG. 7, to elevate the pivot pins 12 upward beyond the base 20. The plate 10 may then be rotated and folded from the vertical working position (FIG. 7) through the middle folding position (FIG. 6) and to the downward folding position (FIGS. 2, 5).

Accordingly, the seat in accordance with the present invention includes a seat back foldable to a compact configuration for greatly reducing the volume of the seat and for facilitating the storing and transportation of the seat.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A seat comprising:

a base including a rear portion having a block extended rearward therefrom for defining a pair of notches in said rear portion of said base, said block including two sides each having an extension extended therefrom and extended inward of said notches of said base respectively, and a plate including an opening formed therein and defined between a pair of legs, said plate including a pair of pivot pins extended from said legs respectively and extended inward of said opening of said plate for engaging into recesses of said extensions respectively, said plate being rotatable about said pivot pins relative to said base between a vertical position and a horizontal folded position relative to said base, and said legs being engaged in said notches of said base respectively when said plate is rotated to the vertical position relative to said base.

2. The seat according to claim 1, wherein said extensions of said block each includes a recess formed therein and communicating with said notches of said base, said pivot pins are engaged into said notches of said base when said plate is rotated to the vertical position relative to said base and when said plate is released.

3. The seat according to claim 1, wherein said block includes a jut extended therefrom, said plate includes a cavity formed therein for receiving said jut of said block and for securing said plate to said base.

4. The seat according to claim 1, wherein said extensions of said block each includes a projection extended therefrom, said plate includes a pair of depressions formed therein for receiving said projections of said extensions and for securing said plate to said base.

5. The seat according to claim 1 further comprising means for retaining said plate to said base.

6. The seat according to claim 5, wherein said retaining means includes a pair of stops secured to said legs and engaged with said extensions for engaging with said extensions and for retaining said plate to said base.

7. The seat according to claim 6, wherein said legs each includes a slot formed therein for receiving said stops respectively, said stops each includes a protrusion extended inward of said opening of said plate for engaging with said extensions.

8. The seat according to claim 7, wherein said extensions each includes a curved surface formed therein for engaging with said protrusions of said stops and for guiding a rotation of said legs of said plate relative to said extensions of said block.

* * * * *